US007137213B2

(12) United States Patent
Kelly et al.

(10) Patent No.: US 7,137,213 B2
(45) **Date of Patent: *Nov. 21, 2006**

(54) STUDDED FOOTWEAR

(75) Inventors: Paul Andrew Kelly, Warwickshire (GB); Lee Paul Shuttleworth, Birmingham (GB); Stephen Keith Clark, Solihull (GB)

(73) Assignee: Trisport, Limited, Staffordshire (GB)

( * ) Notice: Subject to any disclaimer, the term of this patent is extended or adjusted under 35 U.S.C. 154(b) by 137 days.

This patent is subject to a terminal disclaimer.

(21) Appl. No.: 10/409,186

(22) Filed: Apr. 9, 2003

(65) Prior Publication Data

US 2003/0188459 A1 Oct. 9, 2003

Related U.S. Application Data

(60) Provisional application No. 60/393,559, filed on Jul. 5, 2002.

(30) Foreign Application Priority Data

Apr. 9, 2002 (GB) ..... 0208145.3

(51) Int. Cl.
*A43B 5/02* (2006.01)
*A43C 15/16* (2006.01)

(52) U.S. Cl. ..... 36/134; 36/127; 36/128; 36/67 D

(58) Field of Classification Search ..... 36/134, 36/67 D, 65, 59 R, 127, 128, 67 R, 67 A
See application file for complete search history.

(56) References Cited

U.S. PATENT DOCUMENTS 4,587,748 A * 5/1986 Collins ..... 36/127
5,321,901 A * 6/1994 Kelly ..... 36/134
6,272,774 B1 * 8/2001 Kelly ..... 36/134
6,463,682 B1 * 10/2002 Carroll, Jr. ..... 36/134
6,708,428 B1 * 3/2004 Chen ..... 36/134
6,823,613 B1 * 11/2004 Kelly et al. ..... 36/134
2002/0056210 A1 * 5/2002 Kelly et al. ..... 36/127

FOREIGN PATENT DOCUMENTS

| | | |
|---|---|---|
| EP | 0282257 | 9/1988 |
| EP | 0922401 | 6/1999 |
| WO | WO 91/15131 | 10/1991 |
| WO | WO 99/09851 | 3/1999 |
| WO | WO 01/54527 | 8/2001 |
| WO | WO 01/58300 | 8/2001 |
| WO | WO 02/39840 | 5/2002 |

* cited by examiner

*Primary Examiner*—Jila M. Mohandesi
(74) *Attorney, Agent, or Firm*—Edell, Shapiro & Finnan, LLC

(57) ABSTRACT

A shoe stud and receptacle combination for specifically oriented studs, the shoe stud (1) including a ground-engaging part (4). The stud (1) and receptacle (2) are adapted to be secured together by a multi-start threaded connection comprising a screw-threaded spigot (5) on one of the components adapted to be inserted with rotation into a screw-threaded socket on the other component. A locking means (7) of the components is arranged to become interengaged at least when the spigot (5) is fully inserted into the socket (22) to resist unscrewing of the components. The locking means (7) comprises at least one locking assembly (8), the arrangement is such that the relative number and/or position of the threads of the threaded connection and the locking assemblies (8) determine the initial and final positions of the stud (1) relative to the receptacle (2).

25 Claims, 2 Drawing Sheets

STUDDED FOOTWEAR

This application claims priority under 35 U.S.C. §119(e) to U.S. Provisional Application No. 60/393,559 filed on Jul. 5, 2002 the entire content of which is hereby incorporated by reference.

This invention relates to studded footwear such as sports shoes, for example football boots and golf shoes. The term 'football' is intended to encompass all sports known as football, such as soccer, rugby and American and Australian football.

The studs are intended to provide traction, having a ground-engaging part of a type suited to the sport involved. Thus, studs for football tend to have relatively sharp ground-piercing spikes, while those for golf shoes currently have several relatively soft and blunt ground-gripping spikes. The studs are detachably fastened to the sole of the article of footwear, by a screw-threaded spigot on the stud engaging in a correspondingly threaded socket in a receptacle moulded in, or otherwise secured to, the shoe sole.

The screw-threaded connection must be designed to ensure that the stud remains in place, even when high forces are applied, and in particular that it does not unscrew accidentally. Known studs have either a single start thread or a multi-start thread. A single start thread is the simplest thread form, and provides a greater resistance to unscrewing than a multi-start thread. It also provides a strong connection over the several turns of the thread on the spigot and socket. However, because of the number of turns needed to attach and detach the stud, removal and replacement becomes a time-consuming operation. A multi-start thread has a steeper helix angle, which enables a spigot of any given length to be inserted into the socket with less rotation. Also, because a multi-start thread is deeper cut than a single start thread, the shear strength of the thread is greater, so that a shorter spigot can be used.

Whether a single start or multi-start thread is used, the studs and sockets also incorporate a locking ratchet to prevent accidental unscrewing of the studs. Typically, the stud and socket each have a set of teeth, which interengage as the stud is inserted into the socket. The arrangement of the teeth allows the stud to be in any one of a number of positions relative to the socket when it is fully inserted.

The screw threads and locking ratchets described are quite adequate where the rotational orientation of the stud relative to the sole is not significant. In fact, currently most studs are circular or otherwise rotationally symmetrical, and their final orientation relative to the shoe sole is not relevant.

However, in some sports where the forces on the studs are relatively high and of a particular type, such as lateral forces or forces due to rapid forward acceleration of the wearer of the shoe, studs which are specifically oriented can be more effective. (The term "specifically-oriented stud" will be used to include studs which are non-rotationally symmetrical, or studs which are rotationally symmetrical, but whose orientation relative to the shoe sole is significant.) A specifically-oriented stud must be oriented very precisely relative to the shoe sole to ensure that it operates in the desired manner. The known screw-threads and locking ratchets are unable to provide this precise orientation. For example, although a single start thread orients the stud at the start of its insertion, the multiple turns and the locking ratchet mean that its final position cannot be predicted. A multi-start thread of course provides a plurality of starting positions, and the locking ratchet a plurality of end positions.

The invention aims to ensure that a stud can be oriented precisely relatively to its socket and receptacle; orientation of the receptacle relative to the shoe sole is of course necessary, but does not form part of this invention.

According to the present invention, in a combination of a shoe stud and receptacle, the shoe stud includes a ground-engaging part and the two components are adapted to be secured together by a multi-start threaded connection comprising a screw-threaded spigot on one of the two components adapted to be inserted with rotation into a screw-threaded socket on the other component, and a locking means of the components which is arranged to become interengaged at least when the spigot is fully inserted into the socket to resist unscrewing of the components, the locking means comprising at least one locking assembly, the arrangement being such that the relative number and/or position of the threads of the threaded connection and the locking assemblies determine the initial and final positions of the stud relative to the receptacle.

As the initial and final orientation of the stud relative to the receptacle are both determined, the stud can be specifically oriented relative to the receptacle and hence to the shoe sole.

The multi-start threaded connection may have two, three or more starts, to reduce the number of turns required to attach and detach the stud.

Both or all of the threads preferably have the same construction. The initial position of the stud relative to the receptacle is then determined by the number and/or positions of the locking assembly or assemblies. For example, if the threaded connection is a two-start thread, there may be three locking assemblies, positioned so as to allow the threaded connection to engage when the stud is in one orientation, but to prevent its engagement when the stud is in the opposite orientation, since the locking assemblies are unable to start interengaging.

A similar effect will be obtained if the threaded connection is a three-start thread, and there are two or four locking assemblies. In general, the threads and locking assemblies can easily be arranged to define the initial position of the stud relative to the receptacle if the numbers of each are relatively prime.

In an alternative construction, where there is more than one locking assembly, one of the locking assemblies may have a different construction from the other or others. This helps to ensure that the initial position of the stud relative to the receptacle is determined.

The locking means preferably comprises locking assemblies formed by radially facing locking formations on the stud and receptacle operative to interengage when the spigot has been screwed into the socket to a predetermined axial position. One of the locking formations comprises at least one radial projection, while the other comprises at least a radially-facing lead-in ramp, recess and stop means. The projection rides over a lead-in ramp before snapping into a recess, and then engages the stop means to prevent the stud being screwed any further into the socket. The locking assemblies allow the stud to be unscrewed on application of a predetermined torque by resilient yielding of the locking formations. The projections and lead-in ramps may be formed on axially-extending webs surrounding the spigot or socket. The projection of one locking assembly may have a greater axial extent than the other or others, with a corresponding lead-in ramp of smaller axial extent. If this projection engages with one of the other lead-in ramps, it will hold the threads on the spigot and socket out of engagement, thus preventing insertion of the threads at the wrong initial position.

It is easy to arrange the locking assemblies circumferentially relative to the threads to ensure the precise final orientation of the stud relative to the receptacle. The stud may therefore be a specifically oriented stud, and in particular a non-rotationally symmetrical stud.

An embodiment of the invention is illustrated by way of example in the accompanying drawings, in which FIG. 1 is a top plan view of a shoe stud;

Figure 1:
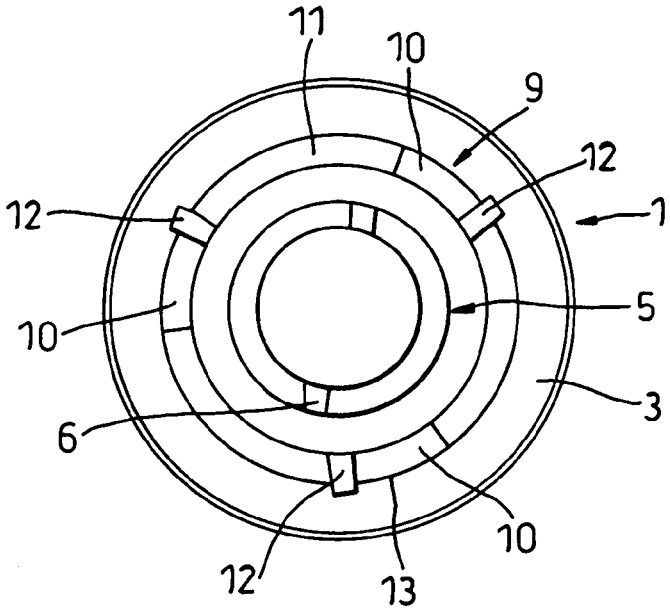
Figure 2:
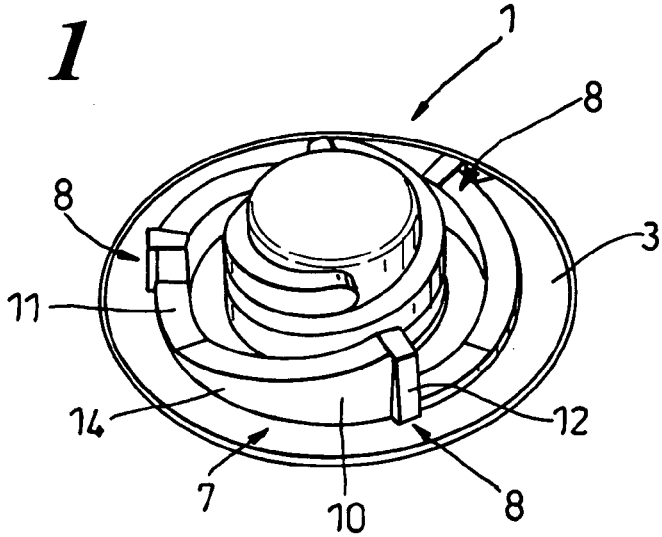
FIG. 2 is a perspective view of the stud of FIG. 1.
Figure 3:
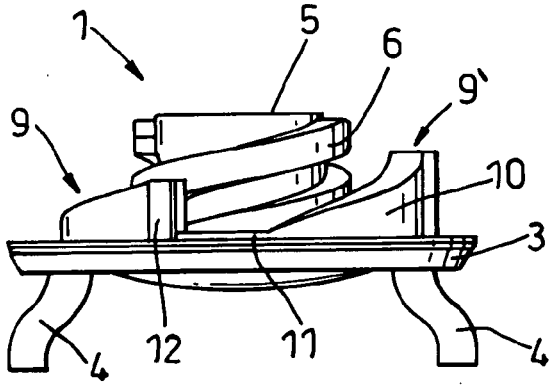
FIG. 3 is a side view of the stud of FIG. 1.

FIGS. 1 to 3 show a stud 1 suitable for use on a sports shoe such as a golf shoe (not shown). The stud 1 is adapted to be inserted with rotation and received in a receptacle 2, shown in FIGS. 4 and 5, which is moulded into or otherwise attached to a sole or heel of the sports shoe.

The stud 1 is a unitary moulding of plastics material and has a circular flange 3. Ground-engaging spikes 4 project from the lower side of the flange 3, while an externally screw-threaded spigot 5 projects from the upper side. The spikes 4 are arranged to be non-rotationally symmetrical. As the spikes 4 of the stud 1 are non-rotationally symmetrical, it requires to be oriented in use relative to the shoe sole. Orientation of the stud 1 in the receptacle 2 is the first stage of this.

The external screw thread on the spigot 5 is a two-start thread 6 with a relatively steep helix angle, so that the stud 1 can be inserted in the receptacle 2 in approximately one-third of a turn. Because of the relatively steep helix angle of the thread, the frictional resistance to unscrewing of the stud 1 is relatively low. The stud 1 and receptacle 2 therefore have a locking means 7, which serves to secure the stud 1 in the receptacle 2, as well as defining its initial and final position relative to the receptacle 2.

The locking means 7 comprises three locking assemblies 8 having co-operating parts in the stud 1 and receptacle 2. The positions of the locking assemblies 8 relative to the two threads 6 On the spigot 5 are arranged to ensure that the stud 1 can only be inserted in one orientation, thus defining the initial position.

The part of each locking assembly 8 provided on the stud 1 is a projection 9. Each projection comprises a part-cylindrical web 10 extending axially from a ring 11 which itself projects axially from the flange 3, co-axial with and radially spaced from the spigot 5. Each projection 9 has a radially-outwardly extending locking projection as an axially-extending rib 12 provided on the leading end (in the screwing-up direction) of the web 10. The rib 12 is substantially rectangular in outline, projecting perpendicularly from the cylindrical outer surface 13 of the web. The trailing end 14 of the web is angled, so that the circumferential dimension of the lower end of the web 10 where it joins the ring 11 is greater than the circumferential dimension at its upper end.

One of the projections 9' has a greater axial height than the other two, extending for perhaps three-quarters of the axial height of the spigot 5.

The axial height of the other two projections is about half that of the spigot 5.

Figure 4:
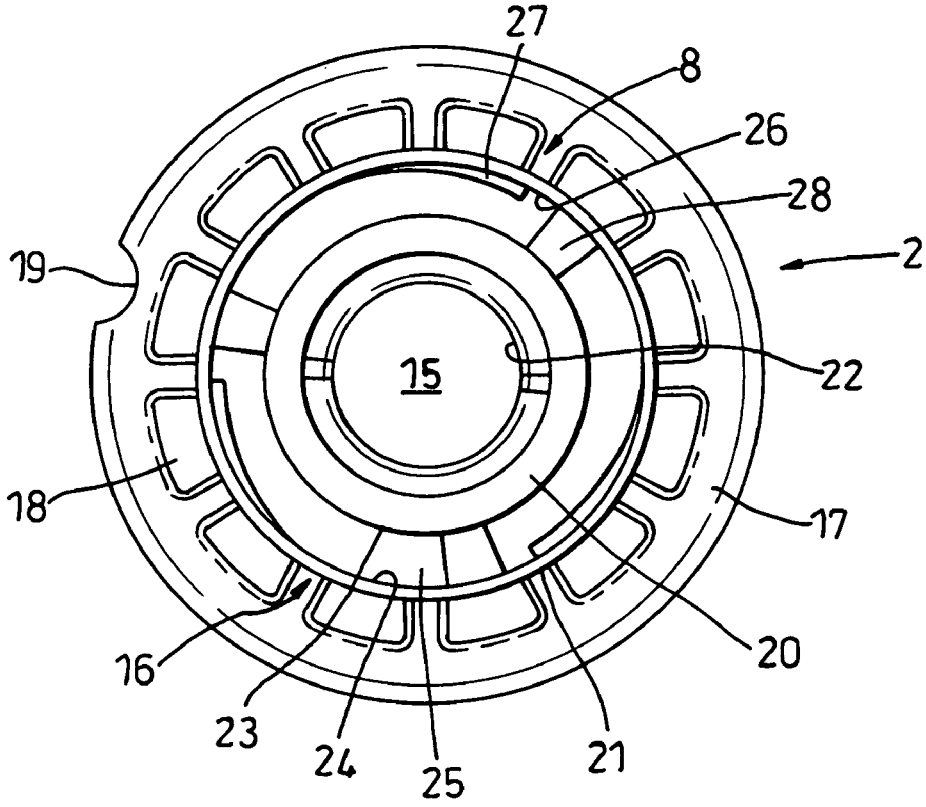
FIG. 4 is an underneath plan view of a receptacle for the stud of FIGS. 1 to 3.
Figure 5:
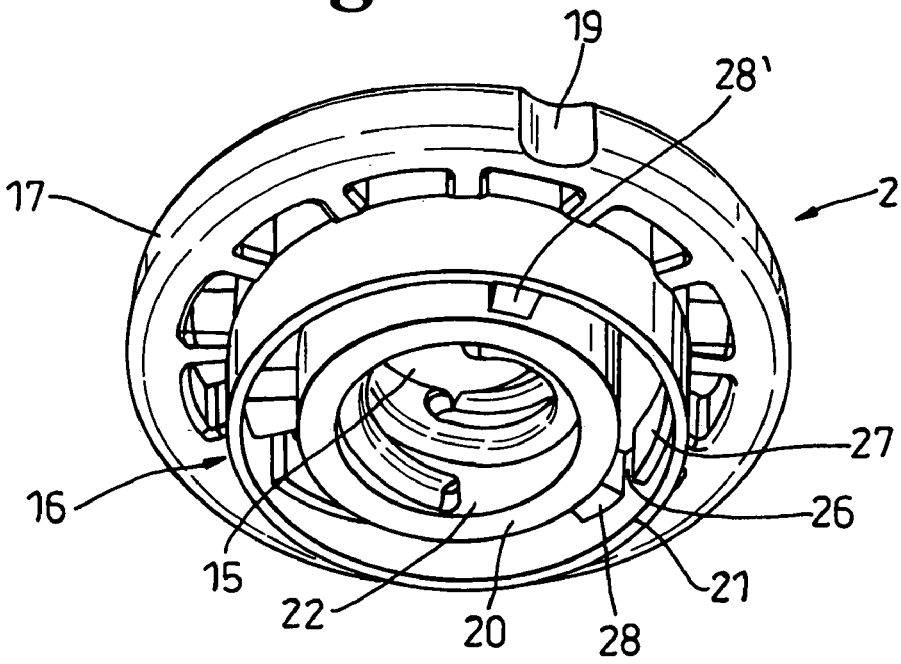
FIG. 5 is a perspective view of the receptacle of FIG. 6.

The receptacle 2 of FIGS. 4 and 5 is also a unitary moulding of plastics material. It has a circular top plate 15 with a central boss 16 depending from it. An annular anchoring flange 17 is formed by a portion of the plate 15 projecting radially outward beyond the boss 16. The flange 17 has apertures 18 which assist in anchoring the flange 17 to the shoe sole or heel, and an indentation 19 at one point in its periphery. The indentation 19 is used to orient the receptacle 2 in the shoe sole or heel.

The boss 16 comprises a stout inner cylindrical wall 20 and a relatively thin and slightly flexible outer wall 21. The walls 20, 21 are co-axial. The inner wall 20 forms an internally screw-threaded socket 22 adapted to receive the spigot 5. The socket 22 also has a two-start thread. The radially outer surface 23 of the inner wall 20 and the radially inner surface 24 of the outer wall 21 are spaced to define an annular space 25 between them, adapted to receive the webs 10 of the stud 1. The co-operating parts of the locking assemblies S are also accommodated in the annular space 25.

The part of each locking assembly 8 provided on the receptacle comprises a locking formation on the outer wall 21, formed on the inner surface 24 to face radially inwards. Each locking formation has a recess 26 bordered on one circumferential side by a lead-in ramp 27, and on the other side by a stop 28. The ramps 27 extend round approximately one-eighth of the circumference of the outer wall 21. Each stop 28 extends from the inner surface 24 of the outer wall 21 to the outer surface 23 of the inner wall 20. The maximum axial height of each ramp 27 is approximately the same as that of its stop 28. Two of the ramps 27 and stops 28 have an axial height of about three-quarters of that of the walls 20, 21, while the third 27', 28' have a lesser axial height. This together with the different axial heights of the projections 9, 9', assists in defining the initial position of the stud 1 relative to the receptacle 2, as explained in more detail below. The engagement of the projections 12 with the stops 28 define its final position.

In use the receptacle 2 is incorporated in the sole or heel of a sports shoe. Normally the receptacle 2 is moulded into the shoe sole or heel, Because the stud 1 needs to be specifically-orientated, the receptacle 2 must also be oriented precisely in the shoe sole or heel. The indentation 19 may be used to orient the receptacle 2 in a mould.

The stud 1 is installed in the receptacle 2 by the insertion of the spigot 5 into the socket 22, with the projections 9 being received in the annular space 25 at the same time. As the thread 6 on the spigot 5 is a two-start thread, there are potentially two orientations in which it can engage with the socket 22. The arrangement of the three locking assemblies 8 however force the stud 1 into one particular orientation, as in the other orientation the projections 9 are prevented from entering the space 25 by engagement with the axial faces of the stops 28. Further, if the projection 9' engages with the stops 28 of greater axial height, the screw threads on the spigot 5 and socket 22 will be held out of engagement; it is only when the spigot 5 is in the correct initial position that the threads can start to engage. Rotation of the stud 1 causes the spigot 5 to be drawn into the socket 22, and the ribs 12 into the space 25. The construction of the threads 6 is such that full insertion of the stud 1 takes only about one-third of a turn. For the last part of the insertion movement the locking projections 12 engage with the lead-in ramps 27, and then snap into the recesses 26 between the ramps 27 and the stops 28. Further rotation is therefore prevented by the engagement of the projections 12 with the stops 28. The outer wall 21 deforms resiliently as the projections 12 ride over the ramps 28, but returns to its original shape when the projections 12 reach the recesses 26. As the projections 12 snap into the recesses 26 they make a click, which can be felt and/or heard, and signal that the insertion of the stud 1 is complete.

The final position of the stud 1 in the receptacle 2 is therefore determined by the locking means 7.

It will be appreciated that the relative numbers and positions of the threads 6 and locking assemblies 8 can be changed, while still retaining the ability to determine the initial and final positions of the stud 1 in the receptacle 2. It would also be possible to employ a different type of locking means (not shown) such as a ring of posts extending axially from one of the components and a ring of radially projecting teeth on the other component. As the spigot is screwed into the socket, engagement of the teeth with the posts causes resilient deflection of the posts, and engagement of the teeth between the posts causes interengagement of the locking means. Of course, the posts and teeth must be arranged so that they allow engagement if the threads in the socket and spigot in only one orientation.

The invention claimed is:

1. A shoe stud and receptacle combination, said shoe stud including a ground-engaging part and said stud and said receptacle are adapted to be secured together by a multi-start threaded connection comprising a screw-threaded spigot on one of said components adapted to be inserted with rotation into a screw-threaded socket on said other component, and a locking means of said components which is arranged to become interengaged at least when said spigot is fully inserted into said socket to resist unscrewing of said components, said locking means comprising at least one locking assembly, wherein the arrangement is such that the spigot and socket can begin to interengage at only one correct initial rotational position of said stud relative to said socket so as to become fully interengaged in only one correct final rotational position of said stud relative to said socket, wherein the relative number and/or position of said threads of said threaded connection and said locking assemblies determine the correct initial and final positions of said stud relative to said receptacle.

2. A shoe stud and receptacle combination according to claim 1, where said multi-start thread is a two-start thread.

3. A shoe stud and receptacle combination according to claim 1, wherein each of said threads has the same construction.

4. A shoe stud and receptacle combination according to claim 2, wherein there are three said locking assemblies.

5. A shoe stud and receptacle combination according to claim 1, wherein there are two said locking assemblies.

6. A shoe stud and receptacle combination according to claim 1, wherein there are four said locking assemblies.

7. A shoe stud and receptacle combination according to claim 1, wherein said locking means comprises more than one said locking assembly and one of said locking assemblies has a different construction to the other or others.

8. A shoe stud and receptacle combination according to claim 1, wherein said locking assemblies are formed by radially facing locking formations on said stud and said receptacle operative to interengage when said spigot has been screwed into said socket to a predetermined axial position.

9. A shoe stud and receptacle combination according to claim 8, wherein one of said locking formations comprises at least one radial projection, while the other comprises at least a radially-facing lead-in ramp, recess and stop means.

10. A shoe stud and receptacle combination according to claim 9, wherein each said projection and said lead-in ramp is formed on axially-extending webs surrounding said spigot or said socket.

11. A shoe stud and receptacle combination according to claim 9, wherein the projection of one said locking assembly has a greater axial extent than said other or others, with a corresponding said lead-in ramp of smaller axial extent.

12. A shoe stud and receptacle combination according to claim 1, wherein said stud is a specifically oriented stud.

13. A shoe stud and receptacle combination according to claim 1, wherein said stud is a non-rotationally symmetrical stud.

14. A shoe stud adapted to be secured to a receptacle by a multi-start threaded connection, said shoe stud comprising:

a ground-engaging part;

a threaded stud part having multiple threads adapted to be threadedly secured to a mating threaded receptacle part of the receptacle upon insertion of one of said threaded parts into the other threaded part and rotation of said stud relative to said receptacle;

stud locking means adapted to become interengaged with receptacle locking means on said receptacle when said one of said threaded parts is fully inserted into the said other threaded part to resist unscrewing of said stud threaded part and said receptacle threaded part, said stud locking means including n locking members for engaging n corresponding locking parts of said receptacle, where n is an integer equal to or greater than 1;

wherein the arrangement is such that said threaded stud part can begin to engage said threaded receptacle part at only one correct initial rotational position of said stud relative to said receptacle so as to become fully interengaged with said receptacle in only one correct final rotational position of said stud relative to said receptacle; and wherein the relative number and/or position of said threads of said threaded connection and said locking members determine the correct initial and final positions of said stud relative to said receptacle.

15. A shoe stud according to claim 14, wherein said multi-start thread is a two-start thread.

16. A shoe stud according to claim 14, wherein each of said threads has the same construction.

17. A shoe stud according to claim 14, wherein n is equal to three.

18. A shoe stud according to claim 14, wherein n is equal to two.

19. A shoe stud according to claim 14, wherein n is equal to four.

20. A shoe stud according to claim 14, wherein n is greater than 1 and one of said stud locking members has a different construction to the other or others.

21. A shoe stud according to claim 14, wherein said locking members are formed by radially facing locking formations on said stud operative to engage radially facing locking formations on said receptacle locking parts when said threaded parts have been screwed together into a predetermined axial position.

22. A shoe stud according to claim 21, wherein one of said locking formations comprises at least one radial projection, while the other comprises at least a radially-facing lead-in ramp, recess and stop means.

23. A shoe stud according to claim 22, wherein each said projection and said lead-in ramp is formed on axially-extending webs surrounding said threaded stud part or said threaded receptacle part.

24. A shoe stud according to claim 14, wherein said stud is a specifically oriented stud.

25. A shoe stud according to claim 14, wherein said stud is a non-rotationally symmetrical stud.

* * * * *

UNITED STATES PATENT AND TRADEMARK OFFICE

CERTIFICATE OF CORRECTION

PATENT NO. : 7,137,213 B2
APPLICATION NO. : 10/409186
DATED : November 21, 2006
INVENTOR(S) : Paul Andrew Kelly et al.

It is certified that error appears in the above-identified patent and that said Letters Patent is hereby corrected as shown below:

Title Page, item (73) Assignee: Change "Trisport, Limited" to
-- Trisport Limited --

Signed and Sealed this

Tenth Day of June, 2008

JON W. DUDAS
*Director of the United States Patent and Trademark Office*